US012038000B2

(12) United States Patent
Warren

(10) Patent No.: US 12,038,000 B2
(45) Date of Patent: Jul. 16, 2024

(54) INJECTION PUMP

(71) Applicant: Texas Injection Corp., Alpine, TX (US)

(72) Inventor: Michael Todd Warren, Alpine, TX (US)

(73) Assignee: Texas Injection Corp, Alpine, TX (US)

( * ) Notice: Subject to any disclaimer, the term of this patent is extended or adjusted under 35 U.S.C. 154(b) by 0 days.

(21) Appl. No.: 17/541,648

(22) Filed: Dec. 3, 2021

(65) Prior Publication Data

US 2022/0178367 A1 Jun. 9, 2022

Related U.S. Application Data

(60) Provisional application No. 63/121,312, filed on Dec. 4, 2020.

(51) Int. Cl.

| | |
|---|---|
| ***F04B 53/10*** | (2006.01) |
| ***F04B 53/00*** | (2006.01) |
| ***F04B 53/16*** | (2006.01) |

(52) U.S. Cl.

CPC ..... *F04B 53/109* (2013.01); *F04B 53/007* (2013.01); *F04B 53/164* (2013.01)

(58) Field of Classification Search

CPC ..... F04B 53/109; F04B 53/007; F04B 53/164
See application file for complete search history.

(56) References Cited

U.S. PATENT DOCUMENTS

| | | | | |
|---|---|---|---|---|
| 2,929,253 | A * | 3/1960 | Baldelli | F16H 21/20 74/44 |
| 3,239,618 | A * | 3/1966 | Sengel | B21C 47/3416 200/61.18 |
| 3,834,840 | A * | 9/1974 | Hartley | F04B 39/00 417/535 |
| 7,878,081 | B2 * | 2/2011 | Sundheim | F04B 41/02 417/399 |
| 8,418,493 | B2 * | 4/2013 | Chang | F04B 39/0094 74/567 |
| 2005/0126518 | A1 * | 6/2005 | Dow | F02B 75/045 123/48 B |
| 2018/0180040 | A1 * | 6/2018 | Quintarelli | F04B 53/06 |

* cited by examiner

*Primary Examiner* — Connor J Tremarche
(74) *Attorney, Agent, or Firm* — Scott L. Harper; Harper & Bates LLP

(57) ABSTRACT

The present invention is directed to an improved liquid additive injection pump that of a type wherein a variety of additive volumes may be metered into a fluid stream or fluid source by adjusting the plunger stroke with an easily accessible adjustment bushing without changing or interrupting, the power supplied to the pump during operation. A robust roller bearing drive is used to power the plunger(s) providing fluid suction and discharge as the plunger(s) cycle, while ensuring accurate and reliable additive injection rates. A spring energized seal eliminates overtightened packing by field technicians. An easily accessible adjustment bushing allows the user to modify the piston stroke length, thereby increasing, decreasing or stopping the volumetric flow of injected additive into a fluid stream or storage container.

10 Claims, 4 Drawing Sheets

INJECTION PUMP

CROSS-REFERENCE TO RELATED APPLICATIONS

This application claims the benefit of U.S. Provisional Patent Application Ser. No. 63/121,312 filed Dec. 4, 2020, and entitled "Injection Pump", which is incorporated herein by reference in its entirety.

BACKGROUND OF THE INVENTION

Electric and other types of injection pump machinery are used to inject additives into a diverse array of fluids. While there are many different injection pump designs and apparatus known in the art, one drawback relates to difficulties in managing the rate and volume of additive to be injected without changing the power input driving the pump piston, which may also be referred to as a plunger herein. As such, a need exists for an improved injection pump which provides the ability to easily adjust the volumetric flow rate the of injected liquid discharged from the injection pump without the need to increase, decrease or stop the pump power supply during operation.

SUMMARY OF THE INVENTION

The present invention is directed to an improved liquid additive injection pump that of a type wherein a variety of additive volumes may be metered into a fluid stream or fluid source by adjusting the plunger stroke with an easily accessible adjustment bushing without changing or interrupting, the power supplied to the pump during operation.

In accordance with one aspect of the invention, a robust split-load roller bearing drive is used to power the piston(s) providing fluid suction and discharge, while ensuring accurate and reliable additive injection rates. A spring energized seal eliminates overtightened packing by field technicians. An easily accessible adjustment bushing allows the user to modify the piston stroke length, thereby increasing, decreasing or stopping the injection of additive into the fluid stream.

In accordance with one aspect of the invention, the injection pump is powered by an electric motor, which may receive power from a variety of sources such as AC service, DC service, and solar cells. The pump may be configured with duplex heads, each with an external easily accessed pump stroke adjustment bushing offering independent flow control from each head.

In accordance with one aspect of the invention, the pump apparatus disclosed herein features an advanced head technology, which includes an enclosed, spring energized seal, interior wiper, no backside suction, and additional seal protection providing increase protection from water and dust ingress. The spring enlarged seal further protects the pump by preventing premature seal wear and unnecessary user error, such as overtightening packing. The provision of a duplex pump head configuration provides the opportunity to reduce the mechanical footprint of the unit and optimize efficiency by utilizing a single motor while doubling injection capability. Fluid flow efficiency is also further maximized by proprietary bubble tight check valves used in the pump unit.

BRIEF DESCRIPTION OF THE DRAWINGS

For a more complete understanding of this disclosure and its features, reference is now made to the following description, taken in conjunction with the accompanying drawings, in which.

DETAILED DESCRIPTION OF THE INVENTION

Figure 1:
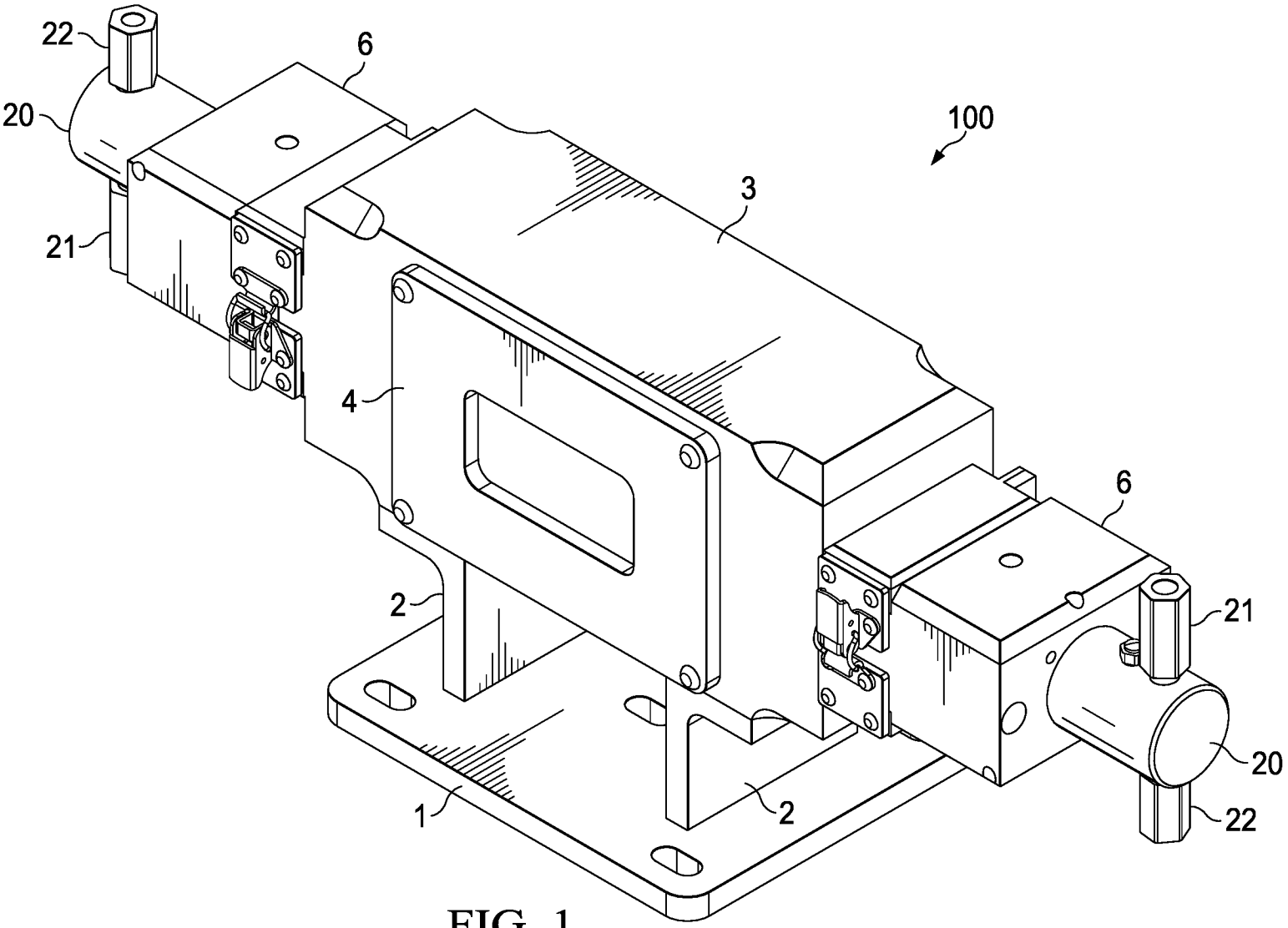
FIG. 1 is a perspective view of an embodiment of the injection pump invention disclosed herein.

As illustrated in FIG. 1, pump assembly 100 according to the invention comprises main body 3 which houses plunger carriage assembly 10 (shown in FIGS. 2 and 3) with attached pump head adjuster blocks 6, pump heads 20 with attached suction valves 21 and discharge valves 22. Main body 3 may be supported and secured to a fixed object or surface with the attachment of base plate 1 to the fixed object or surface. Base legs 2 operate to secure the main body 3 to base plate 1. Face plate 4 and clear plate 5 are attached to main body 3 with screws and may be detached to provide access to the internal components of the plunger carriage assembly 10 for maintenance and parts replacement from time to time. Clear plate 5 allows a user to visually inspect the components housed in main body 3 without the need to remove face plate 4 to visually inspect the components housed in main body 3.

Figure 2:
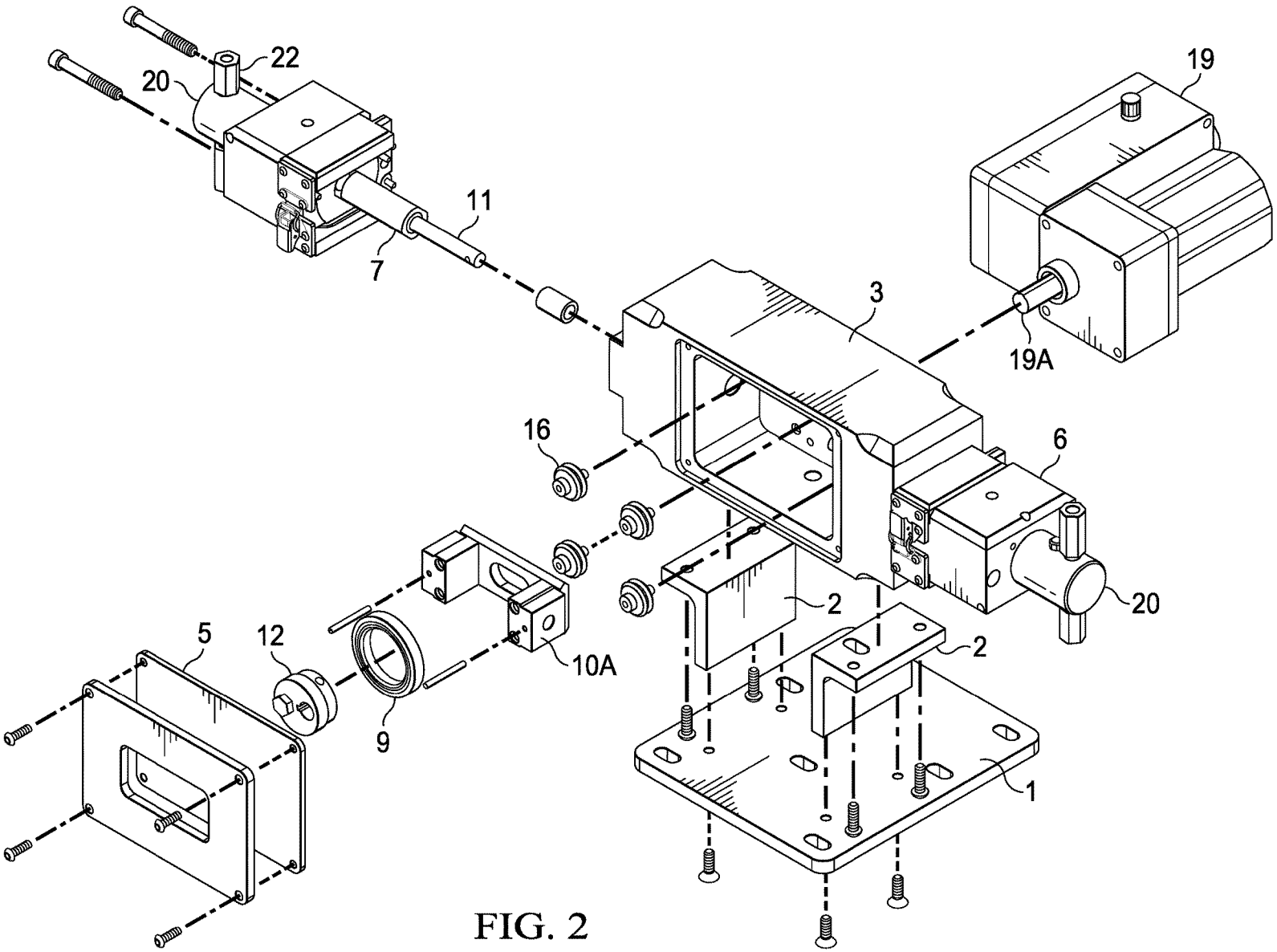
FIG. 2 is an exploded view of an embodiment of the injection pump invention disclosed herein.

FIG. 2 is an exploded view of main body 3 housing plunger carriage assembly 10 components comprising offset bearing 9, carriage block 10A, bearing carrier 12, and roller bearings 16. Motive power source 19, in the depicted embodiment comprising a variable speed electric motor, is fixed to main body 3 with rotor 19A in mechanical communication with plunger carriage assembly 10. When operating under power electric motor 19 provides rotational power to rotor shaft 19A causing the bearing carrier 12 to rotate within offset bearing 9 resulting in the linear translation of the carriage block 10A between roller bearings 16 along a longitudinal axis of plunger(s) 11. The linear translation of carriage block 10A is imparted to overshaft screw 7 and plunger(s) 11 which are in mechanical communication with carriage block 10A. In turn, this operates to provide axial force driving opposing plungers 11 in an axial translating forward and reverse motion which creates alternating negative and positive pressure resulting in the creation of suction and discharge pressure forces that pull liquid additive fluid into annuli 21A of first and second suction valves 21 and discharging liquid additive fluid out of annuli 22A of first and second discharge valves 22 (shown in FIG. 3).

Figure 3:
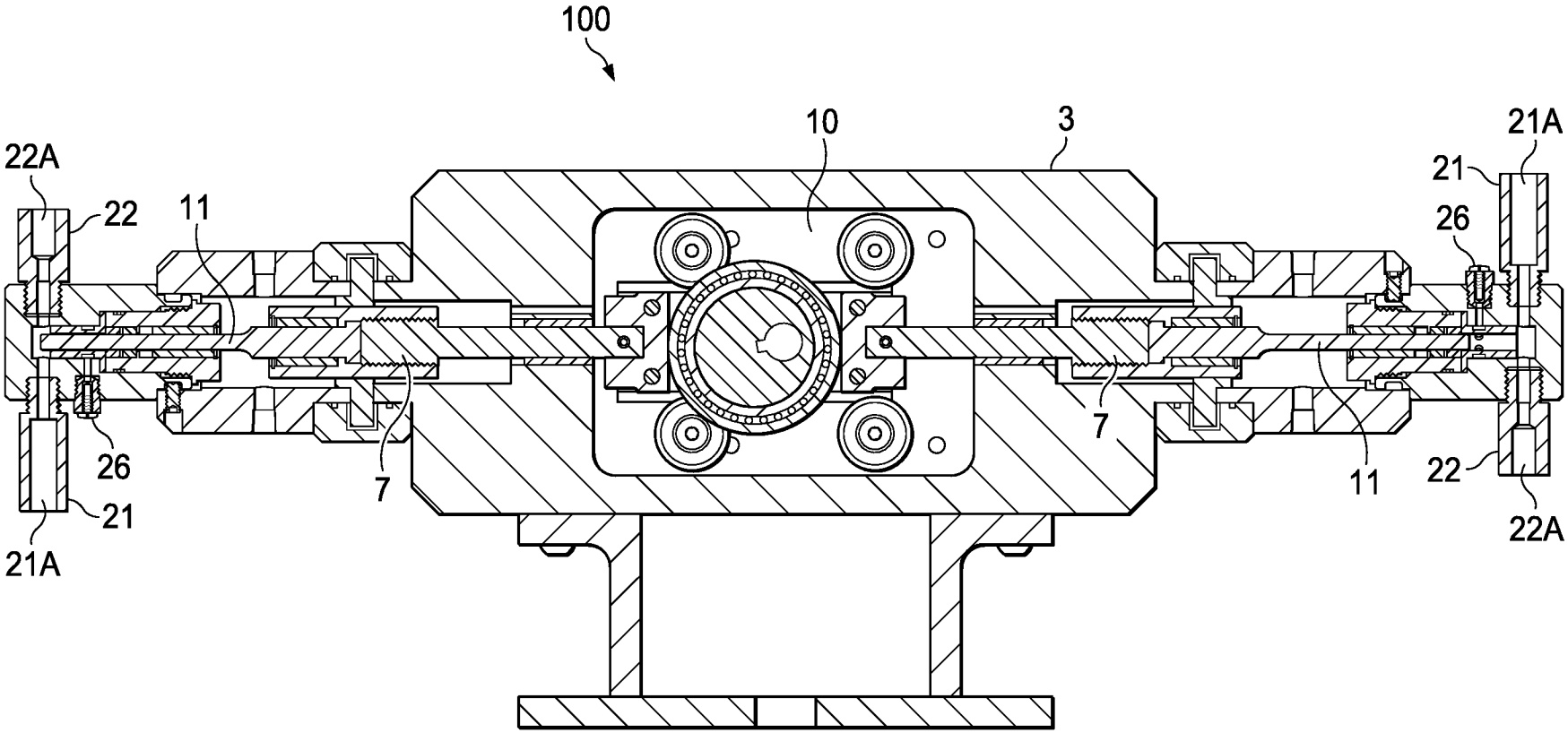
FIG. 3 is a cross-sectional view of an embodiment of the injection pump invention disclosed herein; and, FIG. 4 is an exploded view of the pump head adjust assembly of the injection pump invention disclosed herein.

With reference to FIG. 3, a cross-sectional view of pump assembly 100 is shown. As previously described, motor 19 provides rotational power to rotor shaft 19A causing plunger carriage assembly 10 to impart an axial translating forward/reverse motion to the carriage block 10A to which plunger(s) 11 and overshaft screw 7 are in mechanical communication. In turn, this operates to provide axial force driving opposing plungers 11 in an axial forward and reverse motion which creates alternating negative and positive pressure resulting in the creation of suction and discharge pressure forces that pull liquid additive fluid into annuli 21A of first and second suction valves 21 and discharging the liquid additive fluid out of annuli 22A of first and second discharge valves 22.

Figure 4:
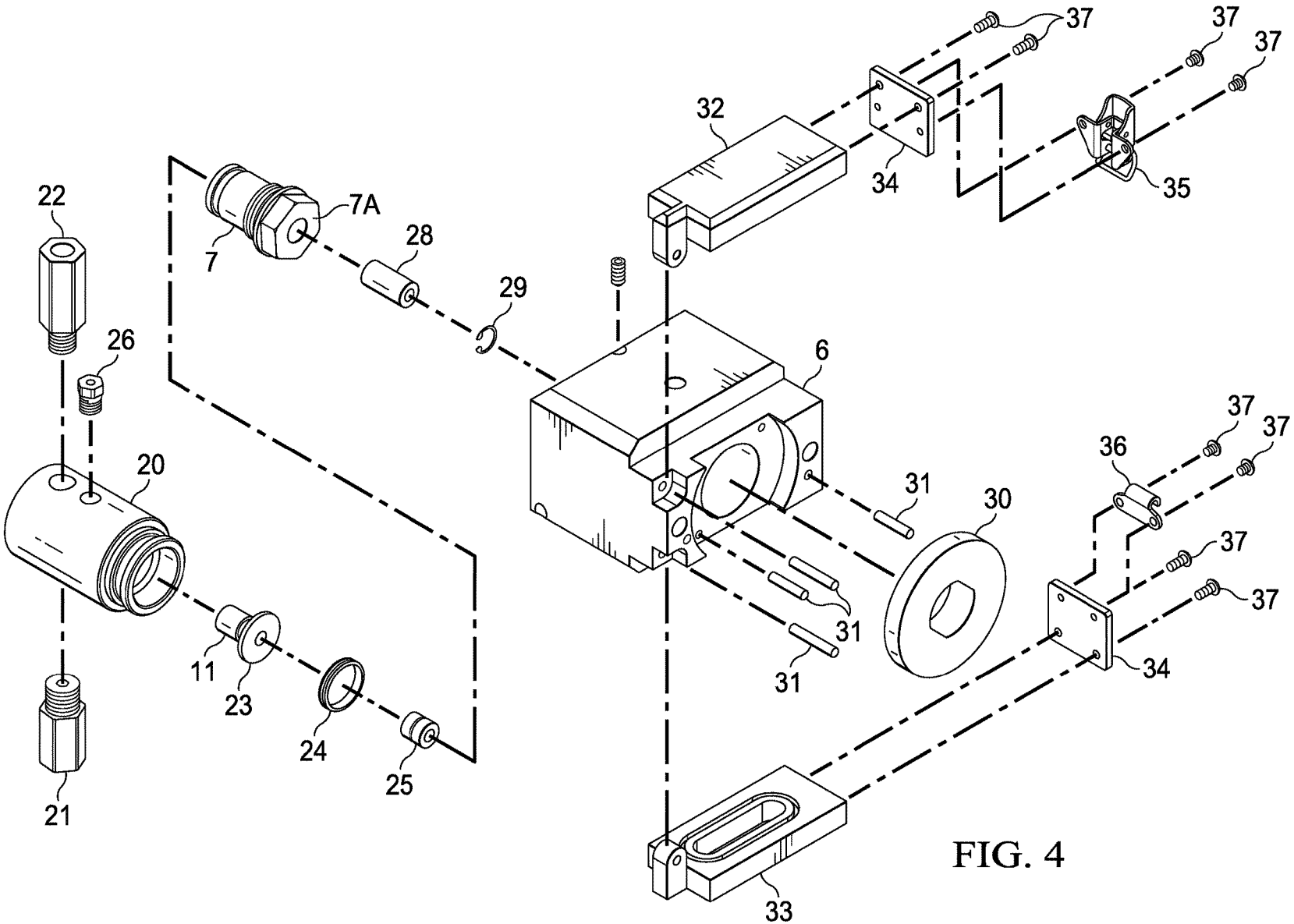

Turning to FIG. 4, an exploded view of pump head adjuster block 6 assembly is shown. The pump head adjuster block 6 is secured to main body 3 and houses plunger overshaft screw 7 which is threadedly attached to plunger 11. Overshaft screw 7 includes a notched head 7A which is in mechanical communication with adjustment bushing 30. Plunger 11 includes a shaft sleeve 23 which is in contact with seals 24, 25 to prevent the influx of additive fluid into pump head adjuster block 6 during operations and provides for the interchange of different plunger sizes without changing out the entire pump head adjuster block 6. Pump head 20 is threadedly secured to pump head adjuster block 6 to provide for easy attachment and detachment for purposes of periodic maintenance or component replacement from time to time. Suction valve 21 and discharge valve 22 are threadedly connected to pump head 20 to provide for easy attachment and detachment for purposes of periodic maintenance or component replacement from time to time. Proprietary bubble tight check valves are incorporated into suction valve 21 and discharge valve 22 to improve fluid flow efficiency. Bleed valve 26 is threadedly connected to pump head 20 to provide the user with the ability to bleed off pressure within the pump head 20 before, during or after pumping operations have commenced. Access to pump head adjuster block 6 is provided by adjuster cowl doors 32, 33 which are attached to pump head adjuster block 6 by cowl latch plate(s) 34 with screws 37, and to which cowl latch 35 and cowl latch keeper 36 are secured.

The stroke length of plunger 11 may be easily adjusted by the user without need for stopping the operation of the pump assembly 100 or removal of the power supplied by motor 19. The user accesses pump head adjuster block 6 which houses the by unlatching cowl latch 35 and opening upper adjuster cowl door 32, lower adjuster cowl door 33, or both as may be required. The user rotates adjustment bushing 30 in a clockwise or counterclockwise direction which has the effect of lengthening or shortening the stroke length of plunger 11. In turn, the lengthening or shortening of the stroke length of plunger 11 directly increases or decreases the volumetric flow rate of liquid additive dispensed by the pump 100.

In an embodiment of the invention, the user may adjust the volumetric flow rate of fluid dispensed from a first pump head 20 to be greater, lesser or equal to the volumetric flow rate of fluid dispensed from a second pump head 20. There is no requirement that each opposed plunger 11 maintain the same stroke length in operation. This allows the user to pump the same or different volumes of additive or additives to the same or different fluid streams at the same or different volumetric flow rates without any requirement to use two or more motor inputs operating at different speeds to adjust the volumetric flow rate.

Typical flow rates using the invention disclosed herein are shown below:

| MODEL | Motor Type | Flow Rate Minimum | Flow Rate Maximum | Working PSI Maximum | Plunger Diameter | Suction & Discharge Connection | Discharge Connection |
|---|---|---|---|---|---|---|---|
| TX 5000 | 12 VDC | 0 | 13.7 USG/D | 5,000 | ¼" | ¼" FNPT | ¼" FNPT |
| TX 5000 | 120 VAC | 0 | 12.9 USG/D | 5,000 | ¼" | ¼" ENPT | ¼" FNPT |
| TX 5000 | 12 VDC | 0 | 33.5 USG/D | 2,300 | ⅜" | ¼" FNPT | ¼" FNPT |
| TX 5000 | 120 VAC | 0 | 31.5 USG/D | 2,300 | ⅜" | ¼" FNPT | ¼" FNPT |
| TX 5000 | 12 VDC | 0 | 60.0 USG/D | 1,150 | ½" | ¼" FNPT | ¼" FNPT |
| TX 5000 | 120 VAC | 0 | 56.4 USG/D | 1,150 | ½" | ¼" FNPT | ¼" FNPT |

Flow rates shown are per head.
Any plunger combination is available for the Single or duplex TX 5000 Series.
Motor Type 12 VDC = Variabie Speed 6-67 RPM Motor,
Class 1 Division 2 Motor Type 120 VAC = 1-Phase/60 Hz Fixed Speed Motor, Class 1 Division 2.

The inventive aspects disclosed herein demonstrate the pump assembly is an economical electric pump solution with diverse capabilities, both onshore and offshore. Well-suited for solar, AC, and DC service, this pump features expandability to duplex heads, each with external mechanical screw adjustment mechanisms offering independent flow control from 0% to 100%. A robust split load roller bearing drive mechanism ensures minimal wear, smooth operation, and long-term durability. This versatile pump features advanced head technology, which includes an enclosed, spring energized seal, interior wipers, no backside suction, and additional seal protection, providing increased protection from water and dust ingress. The spring energized seal further protects the pump by preventing premature seal wear and unnecessary user error, such as overtightening packing. Selecting the duplex pump head configuration provides an opportunity to reduce the chemical injection solution's footprint and optimize efficiency by utilizing a single motor for twice the injection capability. Flow efficiency is further maximized by proprietary bubble tight check valves.

The following is a typical plump classification for an embodiment of the invention disclosed herein:

a. Type: Electric
b. Control: External Mechanical Stroke Length Adjustment and Motor Speed
c. Stroke: 0 to 100%
d. Power Options: 12 VDC (Solar) or 120 VAC/60 HZ/1-Phase
e. FLOW RATE: 0.0-60.0 USG/D (0.0-22.7 L/D)
f. PRESSURE: 0-5,000 PSIG (0-344.8 BARG)

Proprietary, high-quality seal materials enable the pump assembly disclosed herein to provide unparalleled chemical resistance. Wetted components are available in an array of materials. Chemical applications include, but are not limited to:

a. Scavengers (H2S, O2, CO2)
b. Hydrate Inhibitors (MeOH, MEG, LDHI)
c. Foamers and Defoamers
d. Corrosion, Scale, and Paraffin Inhibitors, and
e. Clarifiers, Biocides, Bleaches, and Acids It is also to be understood that the terminology used herein is for the purpose of describing particular embodiments only and is not intended to be limiting. Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of stream-lining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

I claim:

1. An injection pump apparatus, comprising:

a main body housing a plunger carriage assembly in mechanical communication with a motive power source, the plunger carriage assembly comprising an offset bearing, carriage block, bearing carrier and multiple roller bearings housed within the main body housing;

a first pump head adjuster block attached to a first end of the main body housing and a second pump head adjuster block attached to an opposing second end of the main body housing wherein each pump head adjuster block houses an adjustment bushing in mechanical communication with a notched head on an overshaft screw threadedly connected to a plunger with a shaft sleeve, said plunger in mechanical communication with the plunger carriage assembly wherein each adjustment bushing is individually adjustable to separately modify each individual plunger stroke length while the pump is operating; and, a pump head attached to each of the first and second pump head adjuster blocks wherein the first and second pump heads include a suction valve and a discharge valve threadedly attached to the first and second pump heads.

2. The apparatus of claim 1 wherein the motive power source includes a rotor shaft in mechanical communication with the plunger carriage assembly so that the rotating rotor shaft causes the plunger carriage assembly to linearly translate back and forth along a longitudinal axis of each plunger.

3. The apparatus of claim 1 wherein the motive power source powers the injection pump to inject fluids into a fluid stream.

4. The apparatus of claim 1 wherein at least one of the pump head adjuster blocks may be accessed by unlatching a cowl door attached to the pump head adjuster block.

5. The apparatus of claim 1 wherein the stroke length of each plunger may be adjusted by rotating the adjustment bushing associated with each plunger.

6. The apparatus of claim 1 wherein each suction valve further comprises a check valve.

7. The apparatus of claim 1 wherein each discharge valve further comprises a check valve.

8. The apparatus of claim 1 further comprising a bleed valve operatively coupled to each pump head.

9. The apparatus of claim 1 further comprising a seal in contact with the shaft sleeve housed within each pump head.

10. The apparatus of claim 5 wherein adjusting the stroke length of one or both plungers by rotating the associated adjustment bushing alters the volumetric flow rate of fluid discharged by the injection pump.

* * * * *